US006253401B1

(12) United States Patent
Boyd

(10) Patent No.: US 6,253,401 B1
(45) Date of Patent: Jul. 3, 2001

(54) AIR MATTRESS SYSTEM

(76) Inventor: Dennis Boyd, 14457 Rogue River, Chesterfield, MO (US) 63017

( * ) Notice: Subject to any disclaimer, the term of this patent is extended or adjusted under 35 U.S.C. 154(b) by 0 days.

(21) Appl. No.: 09/115,977

(22) Filed: Jul. 15, 1998

(51) Int. Cl.[7] ..... A47C 27/10
(52) U.S. Cl. ..... 5/713; 5/710; 5/935
(58) Field of Search ..... 5/706, 710, 711, 5/712, 713, 935

(56) References Cited

U.S. PATENT DOCUMENTS 3,674,019 * 7/1972 Grant ..... 5/713 X
4,225,989 * 10/1980 Corbett et al. ..... 5/713
4,707,027 * 11/1987 Horvath et al. ..... 297/DIG. 3
4,803,744 * 2/1989 Peck et al. ..... 5/706 X
4,829,616 * 5/1989 Walker ..... 5/713
4,890,344 * 1/1990 Walker ..... 5/713
4,897,890 * 2/1990 Walker ..... 5/713
4,982,466 * 1/1991 Higgins et al. ..... 5/713
4,986,738 * 1/1991 Kawasaki et al. ..... 5/713 X
4,991,244 * 2/1991 Walker ..... 5/713 X
5,062,169 * 11/1991 Kennedy et al. ..... 5/713
5,129,115 * 7/1992 Higgins et al. ..... 5/713
5,152,579 * 10/1992 Bishai ..... 297/284.6
5,267,364 * 12/1993 Volk ..... 5/713
5,375,273 * 12/1994 Bodine, Jr. et al. ..... 5/710
5,421,044 * 6/1995 Steensen ..... 5/713 X
5,425,147 * 6/1995 Supplee et al. ..... 5/713
5,509,154 * 4/1996 Shafer et al. ..... 5/935 X
5,529,377 * 6/1996 Miller ..... 297/DIG. 3
5,652,484 * 7/1997 Shafer et al. ..... 5/935 X
5,657,499 * 8/1997 Vaughn et al. ..... 5/713 X
5,685,036 * 11/1997 Kopfstein et al. ..... 5/713
5,729,853 * 3/1998 Thompson ..... 5/714 X
5,755,000 * 5/1998 Thompson ..... 5/714 X
5,848,450 * 12/1998 Oexman et al. ..... 5/710 X
5,873,137 * 2/1999 Yavets-Chen ..... 5/713
5,890,245 * 4/1999 Klearman et al. ..... 5/710 X
5,903,941 * 5/1999 Shafer et al. ..... 5/935
5,966,762 * 10/1999 Wu ..... 5/713 X
6,058,538 * 5/2000 Chapman et al. ..... 5/713
6,108,843 * 8/2000 Suzuki et al. ..... 5/713
6,148,461 * 11/2000 Cook et al. ..... 5/706 X

* cited by examiner

*Primary Examiner*—Michael F. Trettel
*Assistant Examiner*—Robert G. Santos
(74) *Attorney, Agent, or Firm*—Gregory E. Upchurch; Dennis J. M. Donahue, III; Thompson Coburn, LLP

(57) ABSTRACT

An air mattress system includes a plurality of inflatable air chambers operatively connected to form an air mattress, a reversible air pump operatively connected to the air chambers, and a manually operable control operatively connected to the air pump for controlling the operation of the air pump. The manually operable control has at least a first setting for operating the air pump in a first direction for inflating the air chambers and at least a second setting for operating the air pump in a second direction for deflating the air chambers. Preferably, at least one inflatable air chamber is disposed below the plurality of air chambers to form a foundation for the air mattress. A gauge is included for measuring the air pressure in at least one of the air chambers, the gauge having a display for displaying the measured air pressure to a user.

24 Claims, 2 Drawing Sheets

AIR MATTRESS SYSTEM

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

The present invention relates to air mattresses generally, and more particularly, to an improved air mattress system with independently inflatable sections for providing improved support for a sleeper.

Air beds having independently inflatable mattresses for separate sleepers are known, but they could be improved. For example, currently available air mattresses may "bottom out" when the weight thereon is too high, resulting in an uncomfortable mattress. Single mattresses or pairs of independently inflatable mattresses connected together for separate sleepers may also create a rolling effect when one person lays down on the bed, resulting in the other person being jostled. Moreover, the support for the sleeper's body in many conventional air mattresses is not always satisfactory. Often, due to the sleeper's weight distribution, additional support is needed in the lumbar region. With conventional air mattresses, increasing the inflation pressure to provide the needed lumbar support results in a mattress which is then uncomfortable for the sleepers head and leg positions. Failure to provide adequate lumbar support may result in the sleeper sinking into a "valley" as the mattress compresses in the lumbar region and expand under the sleeper's head and feet due to the reduced weight distribution in those areas.

In many instances, air beds are intended to be deflated often (perhaps daily). For example, air beds used in camping or for temporary home use are deflated frequently. And in many foreign countries the bedding, whether an air bed or more conventional bed, is removed every day. Deflation of an air bed, however, is usually accomplished by letting the air escape through an air valve-sometimes assisted by the user sitting on the mattress as it deflates. Deflation under these circumstances is a fairly time-consuming process. It is, however, necessary to reduce the size of the air mattress for storage.

In those instances in which the air mattress is repeatedly deflated and inflated, it would also be desirable to reinflate the mattress to the same predetermined level each day so that a desired comfort (firmness) could be consistently achieved and easily identified. There are existing air mattresses with pressure gauges but those are not typically designed for the situation where the mattress is repeatedly inflated and deflated.

SUMMARY OF THE INVENTION

Among the several objects and advantages of the present invention are:

The provision of an air mattress system with improved comfort and adjustability.

The provision of such an air mattress system which reduces the problem of "bottoming-out."

The provision of such an air mattress system which is particularly useful in applications requiring frequent inflation and deflation.

In a first aspect of the present invention, an air mattress system includes a plurality of inflatable air chambers operatively connected to form an air mattress, a reversible air pump operatively connected to the air chambers, and a manually operable control operatively connected to the air pump for controlling the operation of the air pump. The manually operable control has at least a first setting for operating the air pump in a first direction for inflating the air chambers and at least a second setting for operating the air pump in a second direction for deflating the air chambers.

In a second aspect of the present invention, an air mattress system includes a plurality of inflatable air chambers operatively connected to form an air mattress, at least one inflatable air chamber disposed below at least one of the plurality of air chambers, and a gauge for measuring the air pressure in at least one of the air chambers. The gauge has a display for displaying the measured air pressure to a user.

The foregoing and other objects, features, and advantages of the invention as well as presently preferred embodiments thereof will become more apparent from the reading of the following description in connection with the accompanying drawings.

BRIEF DESCRIPTION OF THE DRAWINGS

Corresponding reference numerals indicate corresponding parts throughout the several figures of the drawings.

DESCRIPTION OF THE PREFERRED EMBODIMENT

Figure 1:
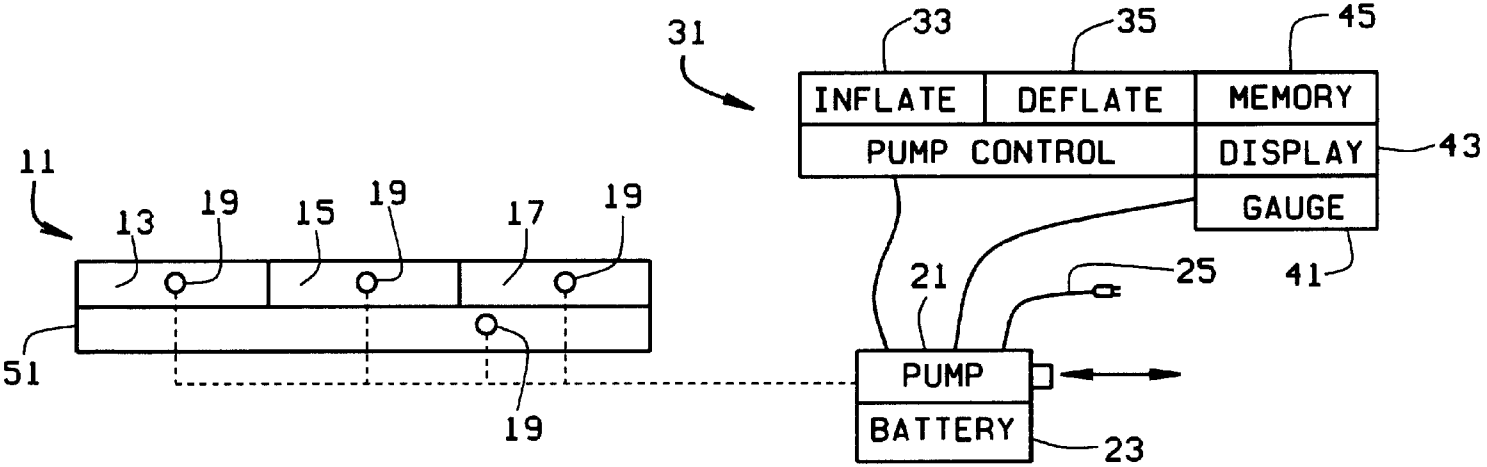
FIG. 1 block diagrammatic view of an air mattress system of the present invention.

An air mattress system 11 (FIG. 1) of the present invention includes a plurality of inflatable air chambers 13, 15, 17 operatively connected to form an air mattress. The air chambers are preferably contiguous and are operatively connected in such a manner that each air chamber includes a standard valve 19 for permitting inflation and deflation of each chamber. Preferably the chambers are inflated and deflated using a reversible air pump 21 operatively connected to the air chambers, as indicated by the dashed lines in FIG. 1. The air pump 21 is reversible, as indicated by the double-headed arrow to the right of the inlet port of the pump, so that it may be used to both inflate and deflate the various air chambers. As shown in FIG. 1, pump 21 is preferably an electric pump powered either by a battery 23 or conventional ac power (indicated by electrical cord 25).

It is preferred that the system include a manually operable control 31 operatively connected to the air pump 21 for controlling the operation of the air pump. Control 31 preferably has a first setting, which is initiated by pressing a switch 33 labelled "inflate", for operating the air pump in a first direction for inflating the air chambers. The control 31 also preferably has a second setting, which is initiated by pressing a switch 35 labelled "deflate" for operating the air pump in a second direction for deflating the air chambers. The control also includes various pump control circuitry 37 responsive to the inflate and deflate switches for causing pump 21 to respond in the corresponding manner. It should be noted that the use of a reversible air pump allows the air chambers to be rapidly deflated when desired.

It is also preferred that control 31 also include a gauge 41 for measuring the air pressure supplied by the pump to the various air chambers. The gauge has associated therewith a display 43 for displaying the measured pressure. It should be appreciated that the measured pressure may vary from chamber to chamber as desired by the user. The pressure for the various chambers may be measured sequentially as each chamber is inflated or, alternatively, separate gauges may be associated with each chamber to simultaneously measure the pressure in each chamber. The display, in this latter case, may display the measured pressures sequentially, or a larger display may be used to display all pressures simultaneously. Control 31 preferably includes a memory 45 for recording the desired pressures in each air chamber, so that the user may conveniently reinflate the chambers to the desired pressures time after time.

Figure 1A:
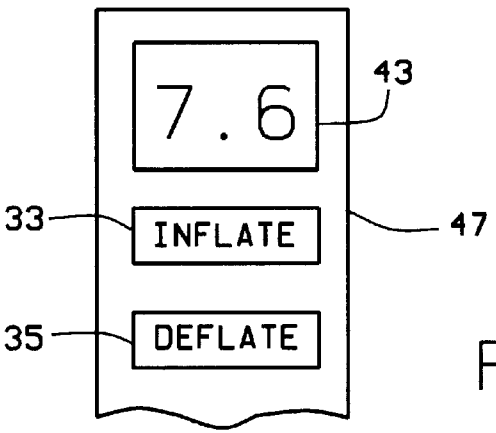
FIG. 1A is a front elevation of a portion of a control for the system of FIG. 1.

It is preferred that the control 31 include a handheld portion 47 (FIG. 1A) on which is disposed display 43 and the inflate and deflate switches 33 and 35. This makes inflation and deflation of the air chambers to the desired pressures extremely convenient for the user. Alternatively, the display and control switches may be disposed at the pump or in some other convenient location.

Figure 2A:
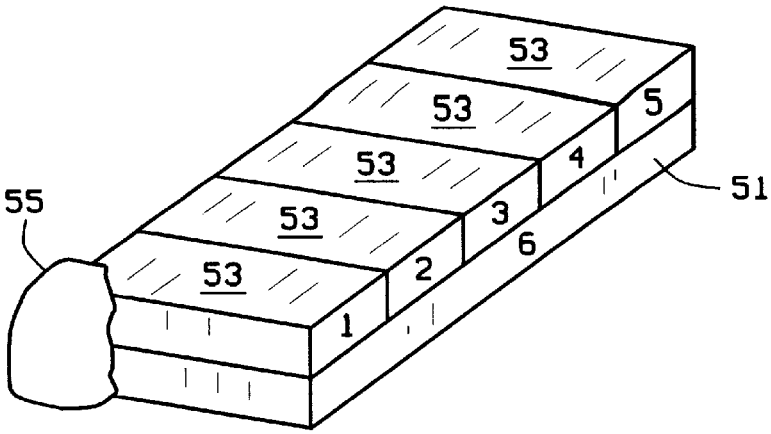
FIGS. 2A–2D are simplified perspective views of various configurations of air mattresses of the present invention.

Referring back to FIG. 1, there is shown an additional inflatable air chamber 51 disposed below the air chambers 13, 15, 17 to form a foundation for the air mattress. As with air chambers 13, 15, 17, the lower air chamber 51 includes its own valve 19. As shown in FIGS. 2A–2D, the particular number, shape and size of the upper air chambers (labelled 53 in these Figs.) may be varied depending upon the particular characteristics of the air mattress desired. Similarly, the size and shape of the lower air chamber 51 may be varied as shown in these Figs. as well. For example, in FIG. 2A the air mattress has five upper air chambers 53 so that the softness of the mattress may be adjusted in five separate zones. In the embodiment of FIG. 2A, the foundation air chamber 51 extends the entire length of the air mattress. FIG. 2D is similar to FIG. 2A, but it shows four upper chambers 53.

Also shown in FIG. 2A is a portion of a cover 55 which in use covers the entire air mattress/foundation system. The cover is optional, but when used can be quilted or non-quilted. It may be cotton, knit, or damask ticking with comfort layers of natural fibers, polyurethane foam, polyester fibers, or latex foam, if desired. Cover 55 may also have an indexed zipper to permit removal of the cover for washing, dry cleaning or replacement. Any of the embodiments may be used with or without a cover as desired.

Figure 2B:
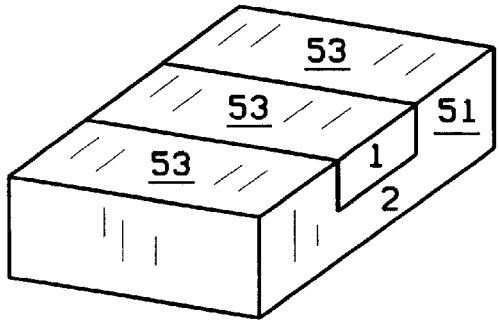
Figure 2C:
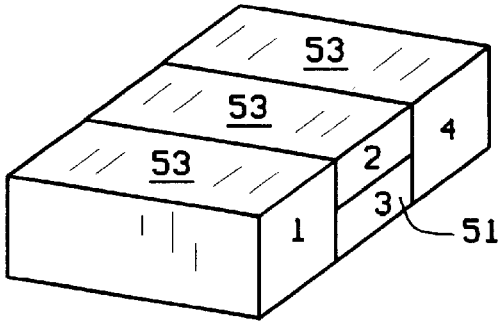
Figure 2D:
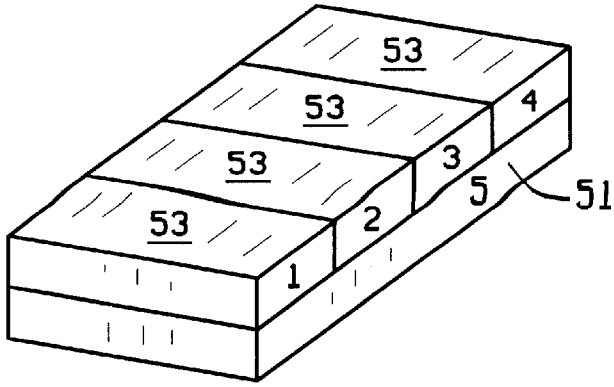

As shown in FIG. 2B, in some instances lower chamber 51 may extend all the way to the top of the mattress in some locations while in others a separate upper air chamber 53 is provided. This particular construction, for example, provides additional protection against "bottoming out" for the lumbar/hip area of the body. The same result is achieved by the embodiment shown in FIG. 2C by providing a lower air chamber 51 only below the lumbar/hip section "2" of three upper air chambers 53.

It should be appreciated that an air mattress of the present invention has numerous advantages over prior art systems. For example, in the camping application, the quick inflation and deflation provided by the present invention provides rapid setup and takedown of the mattress system. The use of the pressure gauge allows inflation to a predetermined level so that the comfort (firmness) setting of the mattress is consistently achieved and easily identifiable. The use of an optional nylon cover in this application protects the air mattress and keeps it clean. The use of a battery operated pump with a pressure gauge is particularly useful for this application.

The air mattress of the present invention is also very useful in the home for use as an additional bed for overnight guests and the like. The mattress can be laid out and quickly inflated each night and quickly deflated each morning. In this application, the use of ac power with the pump is advantageous.

For foreign applications (particularly the Far East) the air mattress of the present invention is a convenient and comfortable alternative to a cotton futon. The rapid inflation and deflation of the air mattress is particularly advantageous in this application.

It should also be appreciated that the air mattress of the present invention is of a size when not inflated that it can be easily shipped for common freight carriers such as UPS and is in fact small enough to be placed on the shelf at commercial discount stores.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

What is claimed is:

1. An air mattress system comprising:

a plurality of contiguous inflatable air chambers operatively connected to form an air mattress having a length and a width, wherein each chamber transversely extends across the entire width of the air mattress and includes a standard valve for permitting separate inflation and deflation of each chamber;

at least one inflatable chamber disposed below at least one of said plurality of air chambers to form a foundation for said air mattress and including a standard valve for permitting separate inflation and deflation from said plurality of air chambers;

a reversible air pump operatively connected to the air chamber through each standard valve; and a manually operable control operatively connected to the air pump for controlling the operating of the air pump, said manually operable control having at least a first setting for operating the air pump in a first direction for inflating the air chambers and at least a second setting for operating the air pump in a second direction for deflating the air chambers.

2. The air mattress system as set forth in claim 1 wherein the air pump is electrically powered.

3. The air mattress system as set forth in claim 1 wherein said manually operable control is disposed in a housing suitable for holding in a user's hand.

4. The air mattress system as set forth in claim 1 wherein said manually operable control is disposed adjacent said air pump.

5. The air mattress system as set forth in claim 1 further including a gauge for measuring the air pressure in at least one of said air chambers, said gauge having a display for displaying the measured air pressure to a user.

6. The air mattress system as set forth in claim 1 further including a cover for covering said inflatable air chambers.

7. The air mattress system as set forth in claim 1 wherein the air pump is battery operated.

8. The air mattress system as set forth in claim 1 wherein the air pump is powered from a line power source.

9. The air mattress system as set forth in claim 1 wherein the manually operable control further includes a memory for storing at least one predetermined air chamber pressure setting.

10. The air mattress system as set forth in claim 1 wherein at least two of said inflatable air chambers are separately inflatable to different pressures.

11. The air mattress system as set forth in claim 1 wherein said foundation air chamber substantially extends across the majority of the width and length of said air mattress.

12. The air mattress system as set forth in claim 1 wherein said foundation air chamber is always at least partially inflated when said air mattress system is in use.

13. An air mattress system comprising:

a plurality of inflatable air chambers operatively connected to form an air mattress having a length and a width, wherein each chamber transversely extends across the entire width of the air mattress and includes a standard valve for permitting separate inflation and deflation of each chamber;

at least one inflatable air chamber disposed below said plurality of air chambers to form a foundation for said air mattress and including a standard valve for permitting separate inflation and deflation from said plurality of air chambers;

a reversible air pump operatively connected to the air chambers through each standard valve; and a gauge for measuring the air pressure in at least one of said air chambers, said gauge having a display for displaying the measured air pressure to a user.

14. The air mattress system as set forth in claim 13 wherein the air pump is electrically powered.

15. The air mattress system as set forth in claim 13 further including a manually operable control for the air pump, said control being disposed in a housing suitable for holding in a user's hand.

16. The air mattress system as set forth in claim 13 further including a manually operable control for the air pump, said control being disposed adjacent said air pump.

17. The air mattress system as set forth in claim 13 wherein the air pump is battery operated.

18. The air mattress system as set forth in claim, 13 wherein the air pump is powered from a line power source.

19. The air mattress system as set forth in claim 13 further including a manually operable control for the air pump, said control further including a memory for storing at least one predetermined air chamber pressure setting.

20. The air mattress system as set forth in claim 13 further including a cover for covering said inflatable air chambers.

21. The air mattress system as set forth in claim 13 wherein at least a second of said inflatable chambers is separately inflatable to a different pressure from said one measured air pressure inflatable air chamber.

22. The air mattress as set forth in claim 21 further including at least one additional gauge for measuring the air pressure in at least one said separately inflatable air chamber, said additional gauge having a display for displaying the separately inflatable air chamber's measured air pressure to a user.

23. The air mattress system as set forth in claim 13 wherein said foundation air chamber substantially extends across the majority of the width and length of said air mattress.

24. The air mattress system as set forth in claim 13 wherein said foundation air chamber is always at least partially inflated when said air mattress system is in use.

* * * * *